US011304499B2

(12) United States Patent
Galvan

(10) Patent No.: US 11,304,499 B2
(45) Date of Patent: Apr. 19, 2022

(54) COOLING BACKPACK APPARATUS

(71) Applicant: Oscar Galvan, Lake Forest, CA (US)

(72) Inventor: Oscar Galvan, Lake Forest, CA (US)

( * ) Notice: Subject to any disclaimer, the term of this patent is extended or adjusted under 35 U.S.C. 154(b) by 0 days.

(21) Appl. No.: 17/003,234

(22) Filed: Aug. 26, 2020

(65) Prior Publication Data

US 2022/0061504 A1 Mar. 3, 2022

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC ..... A41D 13/0053; A41D 13/0058
USPC ..... 224/242
See application file for complete search history.

(56) References Cited

U.S. PATENT DOCUMENTS 5,894,977 A * 4/1999 Krueger ..... A45F 3/042 224/627
6,125,645 A 10/2000 Horn
6,182,874 B1 * 2/2001 Feldman, Jr. ..... A45F 5/00 224/259
D506,314 S 6/2005 Roberts
7,231,777 B1 6/2007 Arnold
8,887,977 B2 * 11/2014 Ralph ..... F42B 39/02 224/666
2002/0113101 A1 8/2002 Skillern
2004/0128747 A1 7/2004 Bumbarger
2006/0276089 A1 12/2006 Amarasinghe
2009/0248121 A1 * 10/2009 Miller ..... A61F 7/02 607/108
2018/0228226 A1 * 8/2018 Corcoran ..... A61F 7/10
2020/0093230 A1 * 3/2020 Ahmed ..... A45B 11/00

FOREIGN PATENT DOCUMENTS

JP 2012020102 A * 2/2012
WO WO2004049846 6/2004

* cited by examiner

*Primary Examiner* — Scott T McNurlen

(57) ABSTRACT

A cooling backpack apparatus for keeping a wearer cool includes a backpack body a front side, a back side, a top side, a bottom side, a left side, and a right side. A pair of shoulder straps is coupled to the backpack body. Each shoulder strap of the pair of shoulder straps is coupled to the back side adjacent the top side and adjacent the bottom side. A plurality of back cold packs is coupled to the back side of the backpack body. Each back cold pack has a specific heat greater than that of water.

7 Claims, 5 Drawing Sheets

COOLING BACKPACK APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to backpack devices and more particularly pertains to a new backpack device for keeping a wearer cool.

(2) Description of Related Art Including Information Disclosed Under 37 CFR 1.97 and 1.98

The prior art relates to backpack devices. Existing devices utilize complex mechanisms with fluid flow to cool a user's back or require an additional component such as a new face or padding to be added to the backpack. Existing devices lack inner strap cooling in addition to full back cooling.

BRIEF SUMMARY OF THE INVENTION

An embodiment of the disclosure meets the needs presented above by generally comprising a backpack body a front side, a back side, a top side, a bottom side, a left side, and a right side. A pair of shoulder straps is coupled to the backpack body. Each shoulder strap of the pair of shoulder straps is coupled to the back side adjacent the top side and adjacent the bottom side. A plurality of back cold packs is coupled to the back side of the backpack body. Each back cold pack has a specific heat greater than that of water.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
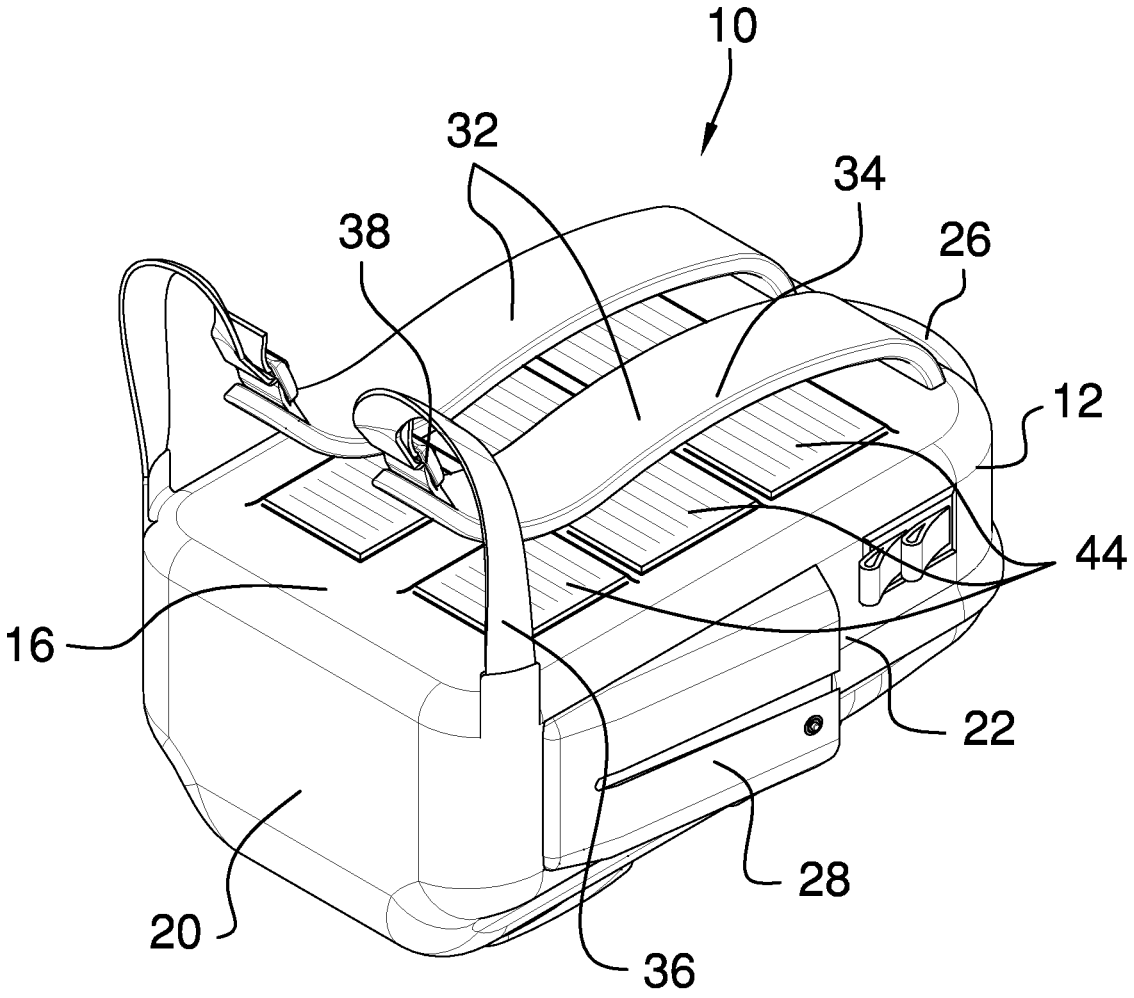
FIG. 1 is an isometric view of a cooling backpack apparatus according to an embodiment of the disclosure.
Figure 2:
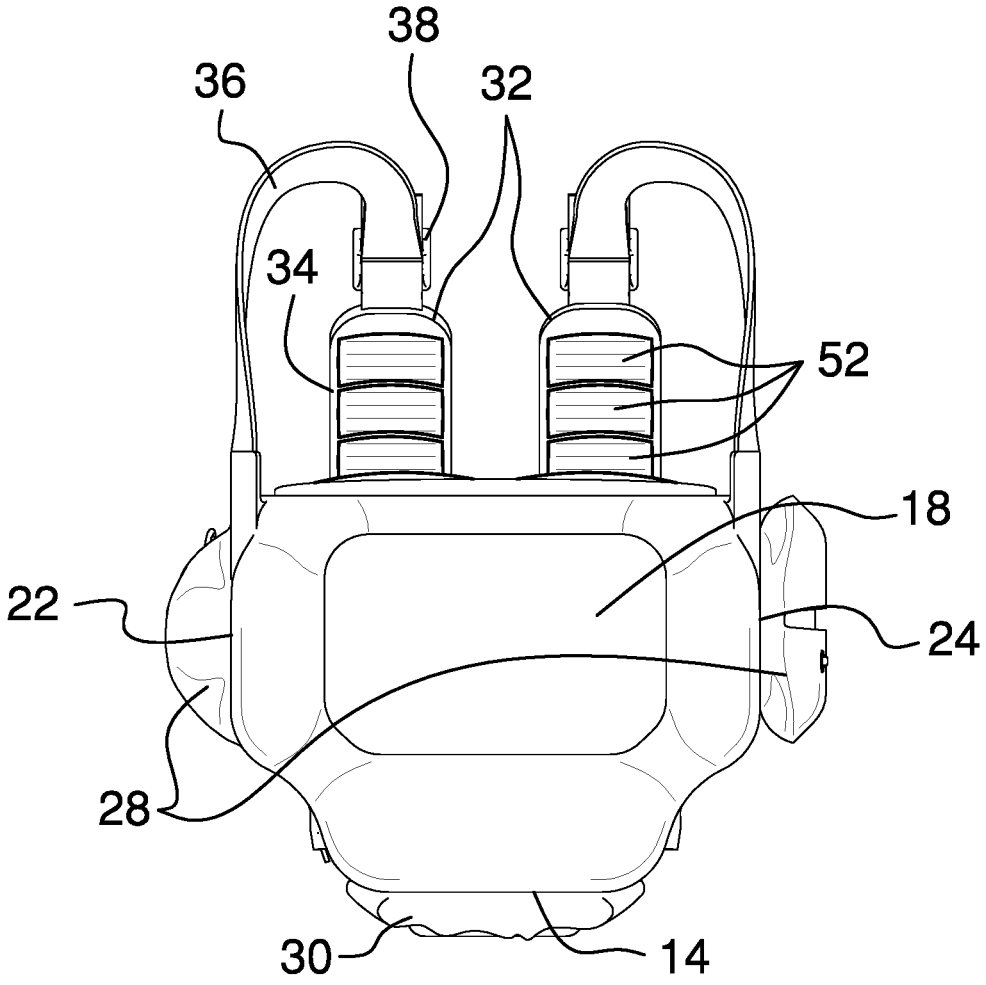
FIG. 2 is a bottom plan view of an embodiment of the disclosure.
Figure 3:
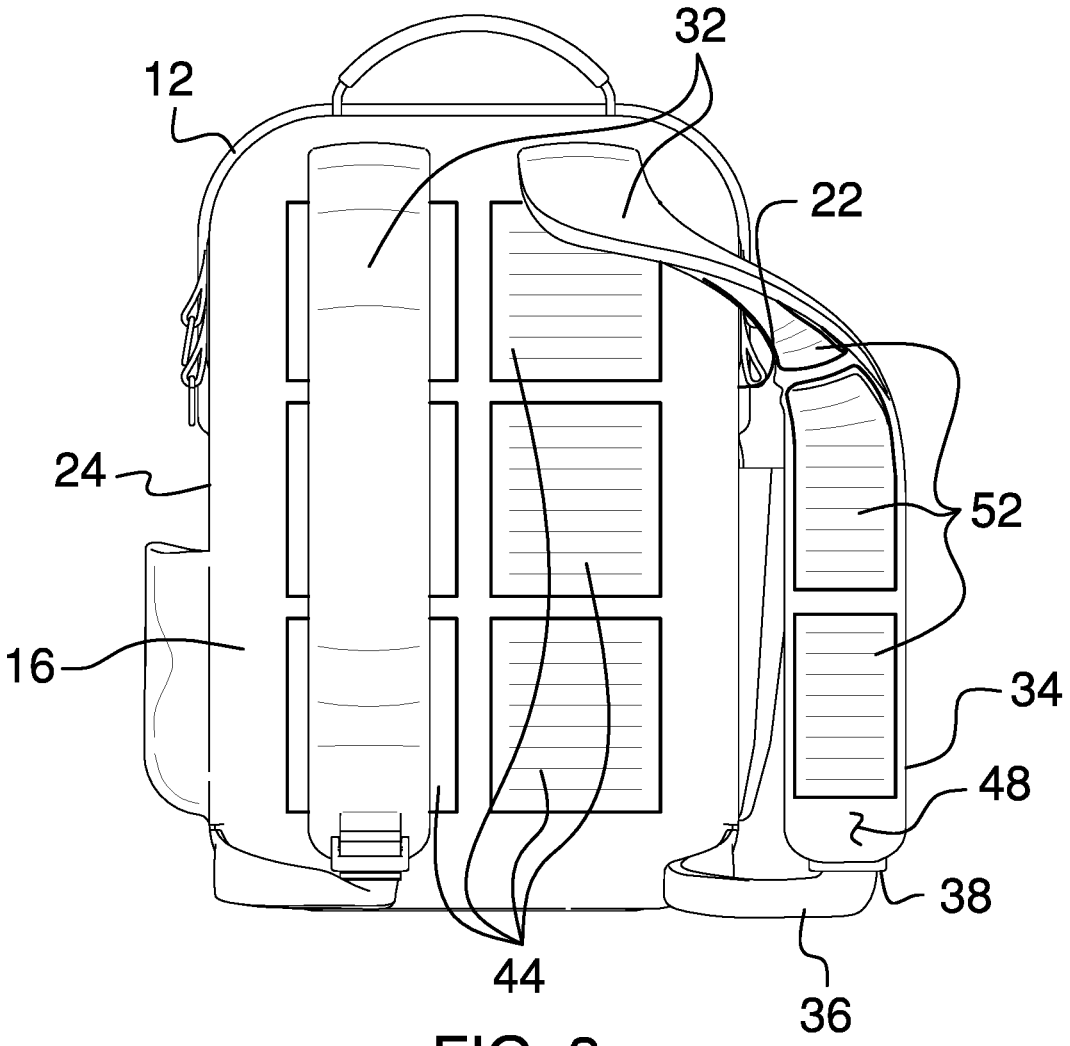
FIG. 3 is a rear elevation view of an embodiment of the disclosure.
Figure 4:
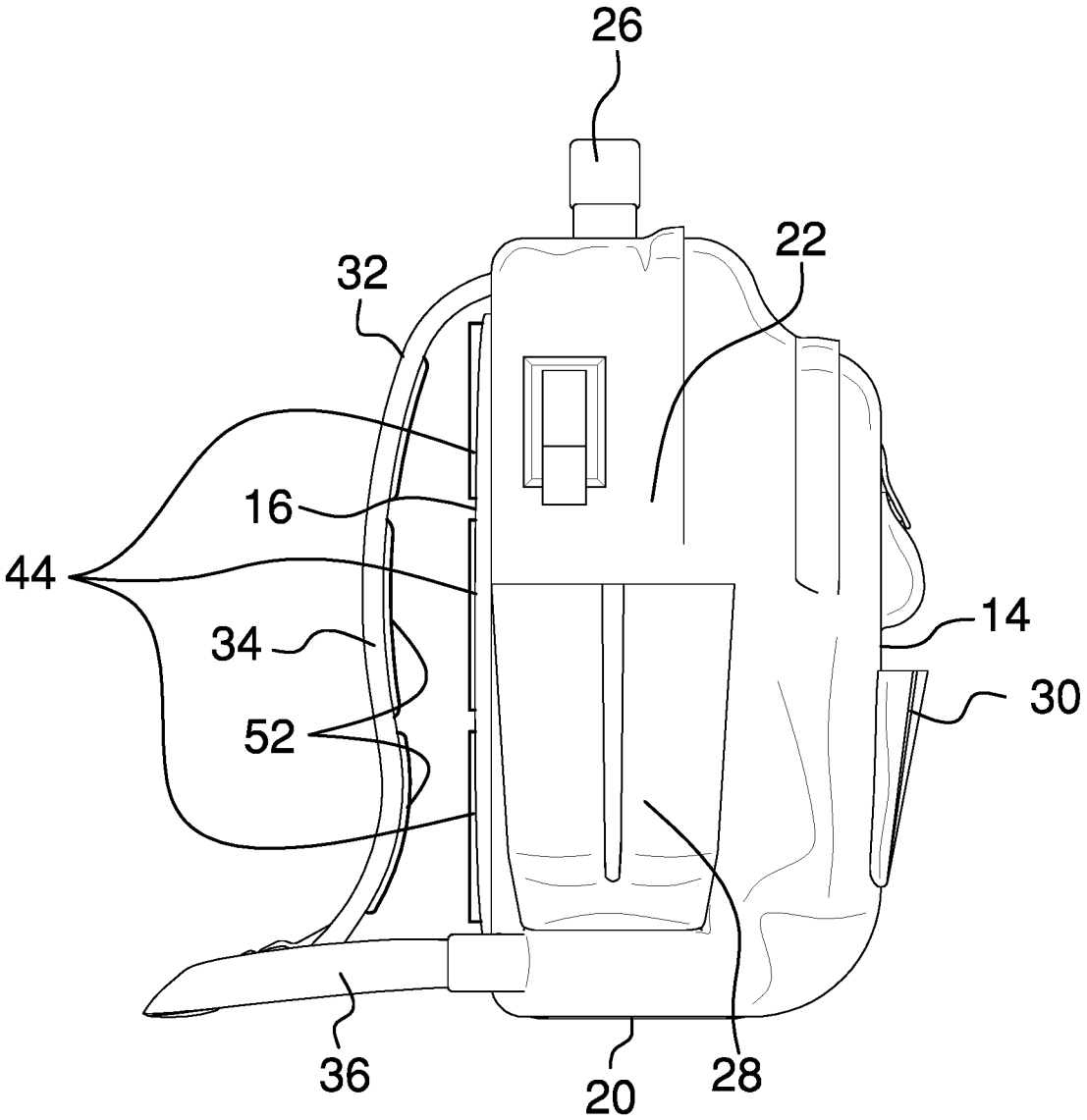
FIG. 4 is a side elevation view of an embodiment of the disclosure.
Figure 5:
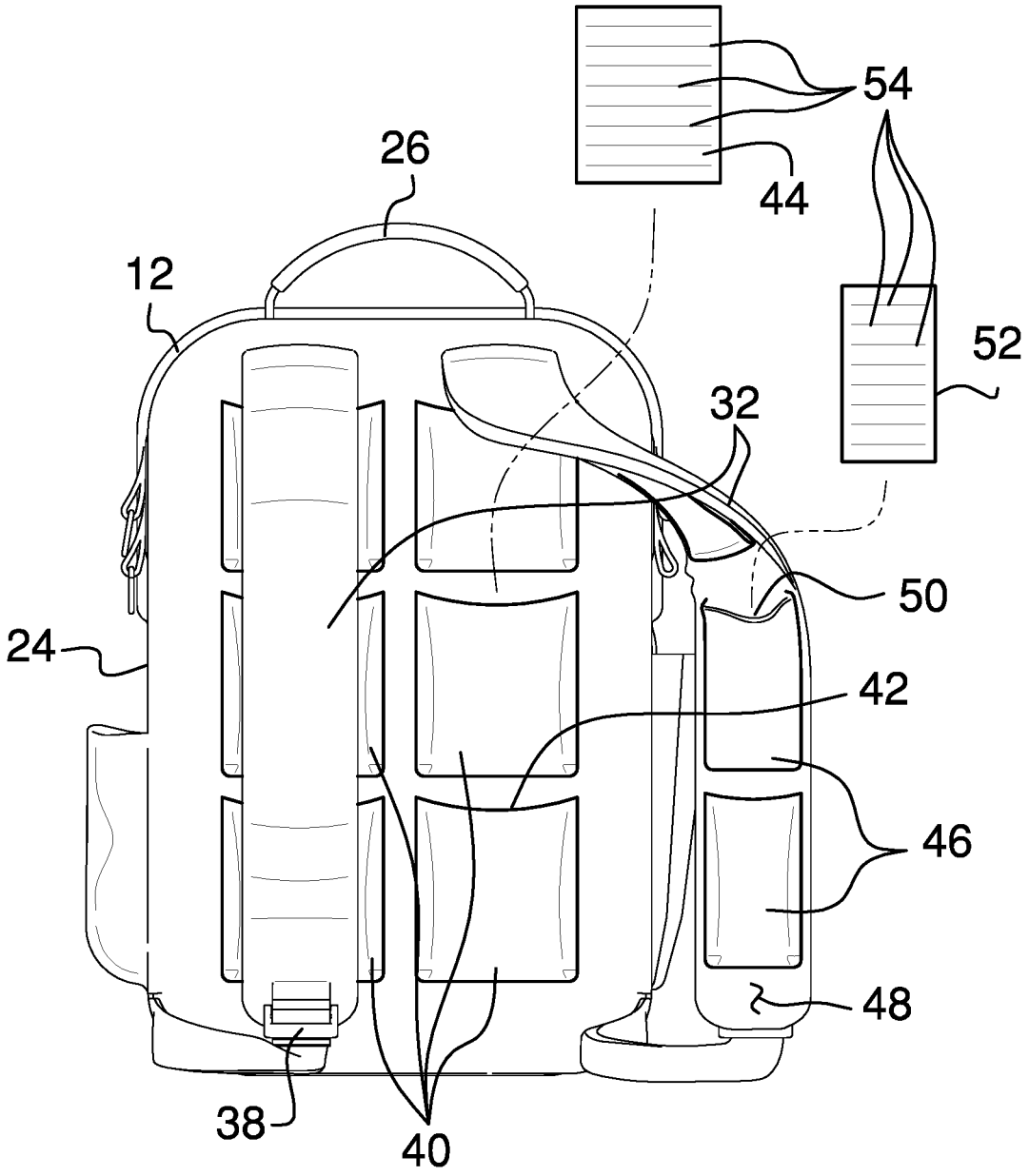
FIG. 5 is a rear elevation view of an embodiment of the disclosure.

With reference now to the drawings, and in particular to FIGS. 1 through 5 thereof, a new backpack device embodying the principles and concepts of an embodiment of the disclosure and generally designated by the reference numeral 10 will be described.

As best illustrated in FIGS. 1 through 5, the cooling backpack apparatus 10 generally comprises a backpack body 12 having a front side 14, a back side 16, a top side 18, a bottom side 20, a left side 22, and a right side 24. A backpack handle 26 may be coupled to the top side 18. The backpack body 12 may have a pair of water bottle pouches 28 coupled to the left side 22 and the right side 24. A backpack front pouch 30 may be coupled to the front side 14.

A pair of shoulder straps 32 is coupled to the backpack body 12. Each shoulder strap 32 of the pair of shoulder straps is coupled to the back side 16 adjacent the top side 18 and adjacent the bottom side 20. Each shoulder strap 32 may comprise an upper padded portion 34 and a lower adjustment portion 36 joined by an adjustment buckle 38.

There may be plurality of back pockets 40 coupled to the backpack body 12. The plurality of back pockets 40 is coupled to the back side 16 of the backpack body with each back pocket 40 having an open back pocket top edge 42. A plurality of back cold packs 44 is coupled within the plurality of back pockets 40. The plurality of back cold packs 44 is selectively engageable within the open back pocket top edge 42 of each back pocket. If there is no plurality of back pockets 40, each back cold pack 44 may be directly coupled to the back side 16 of the backpack body. Each back cold pack 44 of the plurality of back cold packs may be rectangular and protrudes from the back side 16 of the backpack body. The plurality of back cold backs 44 may be arranged in two columns. Each back cold pack 44 has a specific heat greater than that of water to keep the user's back cool. In embodiments including the plurality of back pockets 40, the plurality of back cold packs 44 may first be frozen before being engaged within the plurality of back pockets 40.

A plurality of shoulder pockets 46 may be coupled to the pair of shoulder straps 32. The plurality of shoulder pockets 46 is coupled to an inner face 48 of each shoulder strap 32 and having an open shoulder pocket top edge 50. A plurality of shoulder cold packs 52 is coupled within the plurality of shoulder pocket 46. The plurality of shoulder cold packs 52 is selectively engageable within the open shoulder pocket top edge 50 of each of the plurality of shoulder pockets. If there is no plurality of shoulder pockets 46, each shoulder cold pack 52 may be directly coupled to the inner face 48 of each shoulder strap. Each shoulder cold pack 52 has a specific heat greater than that of water to keep the user's shoulders and chest cool. In embodiments including the plurality of shoulder pockets 46, the plurality of shoulder cold packs 52 may first be frozen before being engaged within the plurality of shoulder pockets 46. Each of the plurality of back cold packs 44 and each of the plurality of shoulder cold packs 52 may have a plurality of horizontal texture ridges 54.

In use, the backpack body 12 is worn using the pair of shoulder straps 32 like a traditional backpack. The plurality of back cold packs 44 and the plurality of shoulder cold packs 52 prevent excessive heat generation between the apparatus 10 and the user's body.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cooling backpack apparatus comprising:

a backpack body, the backpack body having a front side, a back side, a top side, a bottom side, a left side, and a right side;

a pair of shoulder straps coupled to the backpack body, each shoulder strap of the pair of shoulder straps being coupled to the back side adjacent the top side and adjacent the bottom side; and a plurality of back cold packs coupled to the backpack body, the plurality of back cold packs being coupled to the back side, each back cold pack having a specific heat greater than that of water; and a plurality of shoulder cold packs removably coupled to the pair of shoulder straps, the plurality of shoulder cold packs being coupled to an inner face of each shoulder strap, each shoulder cold pack having a specific heat greater than that of water; and each of the plurality of back cold packs and each of the plurality of shoulder cold packs having a plurality of horizontal texture ridges.

2. The cooling backpack apparatus of claim 1 further comprising each of the plurality of back cold packs being rectangular and protruding from the back side of the backpack body.

3. The cooling backpack apparatus of claim 2 further comprising the plurality of back cold packs being arranged in two columns.

4. The cooling backpack apparatus of claim 1 further comprising a plurality of back pockets coupled to the back side of the backpack body, each back pocket having an open back pocket top edge, the plurality of back cold packs being selectively engageable within the plurality of back pockets.

5. The cooling backpack apparatus of claim 1 further comprising a plurality of shoulder pockets coupled to the pair of shoulder straps, the plurality of shoulder pockets being coupled to the inner face of each shoulder strap having an open shoulder pocket top edge, the plurality of shoulder cold packs being selectively engageable within the plurality of shoulder pockets.

6. A cooling backpack apparatus comprising:

a backpack body, the backpack body having a front side, a back side, a top side, a bottom side, a left side, and a right side;

a pair of shoulder straps coupled to the backpack body, each shoulder strap of the pair of shoulder straps being coupled to the back side adjacent the top side and adjacent the bottom side;

a plurality of back cold packs coupled to the backpack body, the plurality of back cold packs being coupled to the back side, each of the plurality of back cold packs being rectangular and protruding from the back side of the backpack body, the plurality of back cold packs being arranged in two columns, each back cold pack having a specific heat greater than that of water; and a plurality of shoulder cold packs removably coupled to the pair of shoulder straps, the plurality of shoulder cold packs being coupled to an inner face of each shoulder strap, each shoulder cold pack having a specific heat greater than that of water, each of the plurality of back cold packs and each of the plurality of shoulder cold packs having a plurality of horizontal texture ridges.

7. A cooling backpack apparatus comprising:

a backpack body, the backpack body having a front side, a back side, a top side, a bottom side, a left side, and a right side;

a pair of shoulder straps coupled to the backpack body, each shoulder strap of the pair of shoulder straps being coupled to the back side adjacent the top side and adjacent the bottom side;

a plurality of back pockets coupled to the backpack body, the plurality of back pockets being coupled to the back side of the backpack body, each back pocket having an open back pocket top edge;

a plurality of back cold packs coupled within the plurality of back pockets, the plurality of back cold packs being selectively engageable within the open back pocket top edge of each back pocket, each of the plurality of back cold packs being rectangular and protruding from the back side of the backpack body, the plurality of back cold packs being arranged in two columns, each back cold pack having a specific heat greater than that of water;

a plurality of shoulder pockets coupled to the pair of shoulder straps, the plurality of shoulder pockets being coupled to an inner face of each shoulder strap and having an open shoulder pocket top edge; and a plurality of shoulder cold packs removably coupled to the plurality of shoulder pockets, the plurality of shoulder cold packs being selectively engageable within the open shoulder pocket top edge of each of the plurality of shoulder pockets, each shoulder cold pack having a specific heat greater than that of water, each of the plurality of back cold packs and each of the plurality of shoulder cold packs having a plurality of horizontal texture ridges.

* * * * *